United States Patent [19]

Schröder

[11] 4,208,763

[45] Jun. 24, 1980

[54] PIVOT BEARING ARRANGEMENT FOR DOORS

[75] Inventor: Gerhard Schröder, Tiefenbronn, Fed. Rep. of Germany

[73] Assignee: Vereinigte Baubeschlagfabriken Gretsch & Co. GmbH, Fed. Rep. of Germany

[21] Appl. No.: 926,705

[22] Filed: Jul. 21, 1978

[30] Foreign Application Priority Data

Aug. 20, 1977 [DE] Fed. Rep. of Germany ..... 2737666

[51] Int. Cl.[2] ..... E05D 7/08

[52] U.S. Cl. ..... 16/151; 85/42; 151/17

[58] Field of Search ..... 16/151, 49, 50, 71, 16/82, 129, 131, 140, 171, 185, DIG. 29; 151/16, 17; 85/42

[56] References Cited

U.S. PATENT DOCUMENTS

| | | | |
|---|---|---|---|
| 842,520 | 1/1907 | Brothers | 16/151 |
| 995,468 | 6/1911 | Kenney | 151/16 |
| 1,179,384 | 4/1916 | Anderson | 16/49 UX |
| 1,228,012 | 5/1917 | Forth | 16/49 |
| 1,608,299 | 11/1926 | Carpenter et al. | 16/151 X |
| 2,820,241 | 1/1958 | Schlage | 16/49 |
| 3,496,594 | 2/1970 | Arthur | 16/49 |
| 3,895,412 | 7/1975 | Johnson | 16/151 |

FOREIGN PATENT DOCUMENTS

| | | | |
|---|---|---|---|
| 345562 | 5/1960 | Switzerland | 16/151 |

*Primary Examiner*—Nile C. Byers, Jr.
*Assistant Examiner*—Moshe I. Cohen
*Attorney, Agent, or Firm*—Craig & Antonelli

[57] ABSTRACT

A pivot bearing arrangement comprises a door closer, a door rotatable relative to the door closer, a shaft journal rotatably supported in the door closer, a journal extension connected in the axial direction for rotation with the shaft journal, the free end of this journal extension connected with the door, wherein the shaft journal and the journal extension are guided so that they are mutually nonrotatable. The improvement comprises mutually facing end surfaces on the shaft journal and on the journal extension provided in a conforming manner, axially aligned threaded bores provided in the mutually facing end surfaces of the shaft journal and of the journal extension, and a threaded pin inserted at either of its ends into one of the threaded bores.

9 Claims, 4 Drawing Figures

PIVOT BEARING ARRANGEMENT FOR DOORS

BACKGROUND AND SUMMARY OF THE INVENTION

The invention relates to a pivot bearing arrangement for doors of the type genrally disclosed in DOS (German Unexamined Laid-Open Application) 2,218,498, wherein a rotationally operable shaft journal of a door closer is to be joined for rotation with a journal extension, the free end of the latter carrying either a closer arm or a door. Thus, the shaft journal and the journal extension are connected so that they are mutually non-rotatable with respect to each other. By means of the shaft of the door closer being split up, the closer can be adapted in a simple way, to different mounting conditions, by attaching to the shaft journal a journal extension or journal adapter having a suitable length and a suitable structure of the coupling area, so that the unit can be coupled to the door.

In a door closer arrangement, the zones of the shaft journal and the journal extension which engage each other in a shape-mating fashion are exposed to a large and suddenly occurring torque load. Therefore, the shape-mating connection must be constructed so that it can reliably absorb great loads and so that it has no free play.

For this purpose, the conventional arrangement provides that the journal extension engages, with a non-circular base portion fashioned like a truncated pyramid, a corresponding recess of the shaft journal. This is done for the purpose of compensating for the unavoidable play due to the manufacturing tolerances. The truncated pyramid is forced in the manner of a wedge into a corresponding recess of the shaft journal. A disadvantage in this connection is the wedging force resulting therefrom, which force acts radially outwardly on the shaft journal. Another disadvantage is the depth of penetration which varies, depending on the tolerance condition. The tangentially aligned shape-mating surfaces likewise transmit force components, effective radially in the same direction and arising from the torque of the closer, to the annular wall of the shaft journal, and therefore this wall is exposed to a high and shock-like stress along the lines of the widening of the wall. In case of passive pivot bearings, i.e. those exerting merely a hinge function and intending to carry only the weight of the door, considerable transverse forces occur due to this door weight, which forces tend to tip the journal extension off the shaft journal.

The same load occurs, of course, in case of active pivot bearings, in addition to the load resulting from the torque transmission, if such pivot bearings of door closers also exert directly the hinge function. This is the case, for example, in most instances with pendulum-type door closers.

This tipping moment resulting from the weight of the door poses great requirements on the load carrying capacity of the tensioning element which is to hold the shaft journal and the journal extension in their engaged and axially aligned position.

Conventional tightening screw connections as shown, for example, in the aforementioned DOS No. 2,218,498, however, have only a low load-bearing capacity. In this prior art construction, a tightening screw is provided which rests with its flaring head section in the journal extension and is threadedly inserted with the threaded shank, which latter is, of course, of a reduced diameter as compared to the head section, in a corresponding threaded bore of the shaft journal. The head configuration of the journal extension, intended for being coupled to a door, is extensively standardized so that the spacing of the coupling surfaces serving here for the torque transmission with respect to the pivot axis is fixedly determined. Since, furthermore, the bore which receives the head section of the tightening screw in a countersunk manner must not rupture these coupling surfaces under any circumstances, the diameter of this bore and, thus, by force of circumstances, the thread diameter of the tightening screw are very strictly limited.

It is, therefore, an object of this invention to provide a pivot bearing arrangement of the aforementioned type which ensures an exact and high-load-bearing seat and shape-mating engagement of the journal extension at the shaft journal while simultaneously reducing the load on the shaft journal and ensuring a sufficient axial tightening force, consequently providing a reliable and permanent connection of the two parts.

This object has been attained with the use of the features set out in the present invention.

The shape-mating connection indicated herein corresponds to the conventional interlocking teeth connection known from German Patent No. 440,816 as "Hirth serrations", and the use of such serrations in accordance with this invention has now opened up a substantial simplification and improvement also in this sector of technology. The substantial advantage of these serrations resides in that this arrangement provides a positive coaxial guidance of the shaft journal with respect to the journal extension and, at the same time, the shape-mating connection is established which is necessary for torque transmission.

Any change in position of the journal extension with respect to the shaft journal leads, due to the special shape of the serrations, to an axial enlargement of the distance between the two parts, so that it is possible merely with the use of an axial tightening screw to secure the axially aligned position as well as to obtain the required rotational rigidity. The radial teeth extend to the outermost rim of the shaft, since no centering ring shoulder is required, so that high torques can be transmitted. During torque transmission, no radially effective force components are produced which could lead to a loosening of the shape-mating interconnection. The Hirth serrations employed, in accordance with this invention, thus make it possible to effect a shape-mating coupling of a shaft journal with a journal extension which can be permanently placed under high loads, wherein the load-bearing limit is determined essentially only by the strength of the anchoring of the tightening screw. Due to the threaded pin to be inserted into the two parts to be joined respectively, there is no longer the necessity of providing a supporting head. The shank diameter of the threaded pin to be inserted in the journal extension can, therefore, be selected to be at least as large as, therefore, the diameter of the supporting head. Consequently, the thread exhibits a significantly greater bearing capacity, and the two parts can be pressed against each other with a considerably greater tightening force.

Although the Hirth serrations per se are conventional (see German Patent No. 440,816), they have been utilized apparently only in the automobile manufacturing field. Also, the arrangement according to French Patent No. 1,533,301 is in the same field of art. This patent employs the Hirth serrations and secures the interlocking position thereof by means of an internally disposed tightening screw which can be threaded with an opposite pitch direction into the two crankshaft sections.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
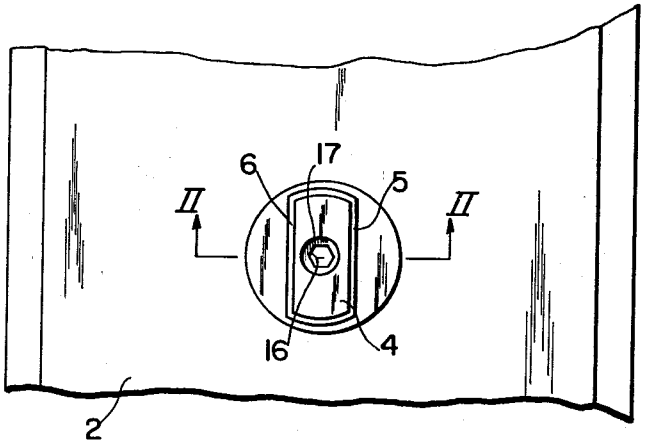
FIG. 1 is a top view of a partially illustrated door closer with the arrangement assembled according to this invention.
Figure 2:
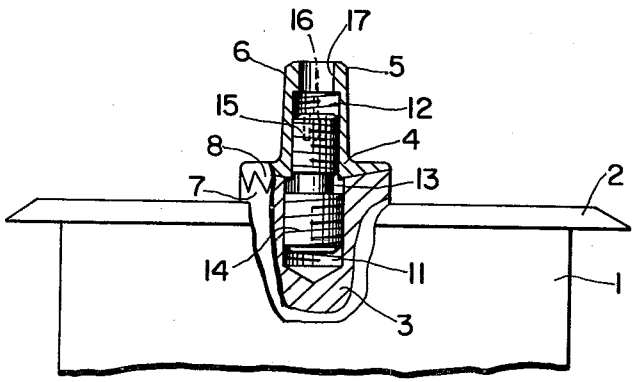
FIG. 2 is a front view of the door closer, partly a section along line II—II of FIG. 1.

FIGS. 1 and 2 illustrate schematically a door closer 1 to be installed in a floor with a cowl plate 2. A shaft journal 3 extends toward the outside through the cowl plate 2. This shaft journal is coupled within the door closer in a conventional manner, not of interest in this application, with drive elements, for example, a closing spring and a hydraulic damping means.

A journal extension 4 is connected in an axial direction for rotation with the shaft journal 3. The free end of this journal extension has coupling surfaces 5 and 6, as is conventional, which serve for transmitting the torque of the door closer 1 to a door. In this connection, the door can preferably be seated with its bottom end directly onto the journal extension 4. The door closer thus becomes itself a pivot bearing for the door.

Figure 4:
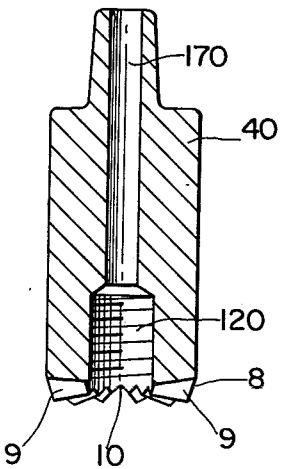
FIG. 4 shows a section along line IV—IV of FIG. 3.

If the door closer 1 is embedded somewhat more deeply into the floor, for example, because perhaps a carpet pad is to be placed thereover, a longer journal extension 40 (FIG. 4) must be attached in place of the short standard journal extension.

Figure 3:
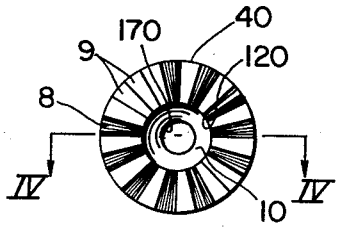
FIG. 3 is a view of one end of a journal extension constructed according to this invention.

The mutually facing end surfaces of the shaft journal 3 and of the journal extension 4 or 40 are provided in conformance with each other with, for example, preferably twelve teeth 7 and 8 or, at least three such teeth, distributed in a ray-shaped pattern over the end face and projecting in the axial direction. The lateral flanks 9 (FIGS. 3, 4) of these teeth are aligned radially with respect to a point 10 on the pivot axis of the journal extension 4 or 40 and/or of the shaft journal 3.

For the row of teeth 7 of the shaft journal 3, and the row of teeth 8 of the journal extension 4 or 40, the point 10 is, in the assembled condition, a common centering focus. Due to the radial orientation of all contacting tooth flanks, no radial forces result from the torque and axial force support, so that the stability of the connection is dependent on the shear strength of the teeth, the angle of inclination of the tooth flanks, and on the load-bearing capacity of the axial tightening screw. Thus, such stability can be very well optimized right from the beginning.

The angle of inclination is conventionally a determining factor for the ratio of dividing the reactive forces resulting from a torque to be transmitted into shear stress on the teeth and tensile stress on the tightening screw. Since the shear strength of the teeth 7, 8, is, on the one hand, dependent on the material (which quality varies with price) and, on the other hand, on the usable shaft cross-section (space requirement) a further increase in the stability and load-bearing limit can be reached, in the final analysis, only by way of improving the tightening screw.

For this purpose, axially aligned threaded bores 11 and 12 or 120 with mutually opposed pitch directions are provided in accordance with the invention in the mutually facing end surfaces of the shaft journal 3 and of the journal extension 4 or 40. A threaded pin 13 is inserted at either or both ends, with a corresponding outer thread 14 and 15, respectively, into one of the threaded bores 11, 12. For the threaded engagement and disengagement, the end face of the pin 13 inserted in the journal extension 4 is provided with a hexagonal hole 16, and the journal extension 4 or 40 is provided with an axial bore 17 or 170 terminating in the axially aligned threaded bores 11 and 12 or 120. A screwdriver, hexagonal bar, or another shape-mated tool can be introduced through the axial bore 17, 170, into the hexagonal hole 16.

In the example, the threaded bore 11 and the outer thread 14 are fashioned as a right-hand thread and the threaded bore 12 and the outer thread 15 are fashioned as left-hand threads. To loosen the connection, therefore, the threaded pin 13 must be turned in the counterclockwise direction, and, for tightening the connection, the threaded pin 13 must be turned in the clockwise direction.

It is to be noted that the axial bore 17 for the penetration of the screwdriver or other tool can be formed or replaced by a direct continuation of the threaded bore, if this is more advantageous for reasons of production and stability. This bore can furthermore be provided with a normal right-hand thread for the reception or fixation of a stopper or a cover cap.

As regarding FIG. 2, the threaded bore 12 in the short journal extension 4 is made with a smaller diameter than that of the axially aligned threaded bore in the shaft journal 3. However, regarding FIG. 4, it should be pointed out that the threaded bore 120 in the long journal extension 40 has a larger diameter than the threaded bore 12 shown in FIG. 2, and has especially a diameter as large as that of the threaded bore 11 in the shaft journal 3. Thus, the attainable additional increase in ruggedness works in favor of the actually higher load because of the greater axial length of the journal extension 40.

According to another preferred embodiment of the invention, the threaded bore 12 of the journal extension 4 is fashioned with a greater pitch than the threaded bore 11 in the shaft journal 3 but with the same pitch direction. Such a measure has the advantageous consequence that the portion of the threaded pin 13, though smaller in diameter, is threadedly inserted more deeply, i.e. with an outer thread 15 which is longer in the axial direction, into the journal extension 4, whereby the total load-bearing capacity of the tightening connection becomes higher.

If lower requirements are posed with respect to the capacity for torque transmission, then it is contemplated in another modification of the illustrated embodiment, to reduce the shape-mating connection to a frictional connection. In other words, the journal extension 4 can contact with a planar end face, for example, a likewise planar end face of the shaft journal 3. The advantage provided by the threaded pin 13 which, according to the invention, engages both parts 3 and 4 from their end faces, namely the attainable high tightening force, results in a rugged and durable connection of high load-bearing capacity with respect to any occurring tipping moments (e.g. due to the weight of the door) even in case of passive pivot bearing arrangements.

Another important advantage of the shape-mating coupling arrangements according to this invention, where utilizing the form of the Hirth serrations, resides in the simplicity with which the journal extension 4 or 40 can be dismounted from the shaft journal 3. For, after loosening the threaded pin connection 13, the journal extension 4 or 40 can be taken off without the aid of a drawing-off unit. Thus, if the wrong journal extension 4 or 40 was perhaps erroneously mounted, this can be corrected without any substantial effort.

From the above general description, it should be clear that the several embodiments of the present invention involve a very simple solution to a long-standing problem in the art of door closer construction. The present invention, by providing a pin threaded at both ends for connecting the shaft journal and journal extension together, assures that a more positive connection is obtained that is the case in the prior art devices which utilize a mere screw and which therefore necessarily require an inordinately larger aperture in the journal extension. For assuring this positive connection Hirth serrations are employed.

The foregoing preferred embodiments are considered illustrative only. Numerous modifications and changes will readily occur to those skilled in the art.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. In a pivot bearing arrangement, comprising:

a door closer;

a shaft journal rotatably supported in the door closer;

a journal extension connected in the axial direction for rotation with the shaft journal, the free end of this journal extension adapted to be connected with a door;

wherein the shaft journal and the journal extension are connected so that they are mutually nonrotatable;

wherein the improvement comprises:

mutually facing end surfaces on the shaft journal and the journal extension, said end surfaces matingly interfitting or provide said mutually nonrotatable connection;

axially aligned threaded bore means provided in the mutually facing end surfaces of the shaft journal and of the journal extension; and a threaded pin having two ends, one end being inserted into the threaded bore means provided in the end surface of the shaft journal and the other end being inserted into the threaded bore means provided in the end surface of the journal extension, further comprising at least three teeth distributed over the mutually facing end surfaces and projected in the axial direction of the shaft journal, lateral flanks on the teeth being aligned radially with respect to a center point on the axis of rotation on the shaft journal, a shape-mated means for coupling a tool on an end face of the threaded pin inserted into the journal extension, and an axial bore means for penetrating the journal extension, said axial bore means terminating in the axially aligned threaded bore means.

2. Pivot bearing arrangement, according to claim 1, wherein the teeth number twelve or more.

3. Pivot bearing arrangement according to claim 1, wherein the shape-mated means is a hexagonal hole means.

4. Pivot bearing arrangement, according to claim 1, wherein the axially aligned threaded bore means of the shaft journal and of the journal extension are fashioned with differing diameters.

5. Pivot bearing arrangement, according to claims 1 or 4, wherein the axially aligned threaded bore means of the shaft journal and of the journal extension are fashioned with a different pitch but with the same pitch direction.

6. Pivot bearing arrangement, according to claims 1 or 4, wherein the axially aligned threaded bore means of the shaft journal and of the journal extension are fashioned with mutually opposed pitch directions.

7. Pivot bearing arrangement, according to claims 1 or 4, wherein the shaft journal is adapted to be coupled to a journal extension of a different length.

8. Pivot bearing arrangement according to claim 7, wherein the shaft journal is coupled to a journal extension of a short length and further wherein the axially aligned threaded bore means in said short journal extension is made with a smaller diameter than that of the axially aligned threaded bore means in the shaft journal.

9. Pivot bearing arrangement according to claim 7, wherein the shaft journal is coupled to a journal extension of a long length and further wherein the axially aligned threaded bore means in said longjournal extension is made with a diameter as large as that of the axially aligned threaded bore means in the shaft journal.

* * * * *